United States Patent [19]

Walker et al.

[11] 4,014,371

[45] Mar. 29, 1977

[54] MATTRESS MAKING MACHINERY

[75] Inventors: Bertram Walker, Long Eaton; Harold Fred Beviss, Ilkeston, both of England

[73] Assignee: Elson & Robbins Limited, Long Eaton, England

[22] Filed: Dec. 30, 1974

[21] Appl. No.: 537,465

[30] Foreign Application Priority Data

Jan. 10, 1974 United Kingdom ..... 1158/74

[52] U.S. Cl. ..... 140/3 CA; 140/92.7; 140/92.94

[51] Int. Cl.[2] ..... B21F 27/00; B21F 45/16

[58] Field of Search ..... 140/3 CA, 92.3, 92.7, 140/92.8, 92.94

[56] References Cited

UNITED STATES PATENTS

| | | | |
|---|---|---|---|
| 2,351,659 | 6/1944 | Bronstein et al. | 140/3 CA |
| 2,388,106 | 10/1945 | Woller | 140/92.7 |
| 2,630,145 | 3/1953 | Stevens | 140/92.3 |
| 3,585,700 | 6/1971 | Jansson | 140/3 CA |
| 3,774,652 | 11/1973 | Sturm | 140/3 CA |

FOREIGN PATENTS OR APPLICATIONS

| | | | |
|---|---|---|---|
| 549,166 | 7/1956 | Belgium | 140/3 CA |

*Primary Examiner*—C.W. Lanham
*Assistant Examiner*—E. M. Combs
*Attorney, Agent, or Firm*—Thomas W. Speckman

[57] ABSTRACT

This invention is concerned with manufacture of spring interior units using known machinery for the manufacture of hour-glass shaped spring members wherein a plurality of the hour-glass shaped spring members are conveyed to a locality whereat a plurality of said hour-glass shaped spring members are displaced in a form of a row located adjacent to another row of springs whence the two rows of springs are joined together at both their end convolutions and the process repeated until a spring interior unit with a predetermined number of rows of springs is formed automatically.

6 Claims, 4 Drawing Figures

MATTRESS MAKING MACHINERY

This invention is for improvements in or relating to spring interior unit making machinery and has for one object to provide improved apparatus for the formation of spring units substantially automatically from a coil of wire. The expression "spring interior unit" refers to a unit consisting of a plurality of conventional hour-glass shaped springs which are held together in rows by a coil spring extending through the end convolutions of each end of the hour-glass spring so as to join together adjacent rows of hour-glass springs. Such units are used not only for the formation of mattress assemblies, being the interior spring unit, but also in other forms of spring upholstered furniture such as seats and back squabs in motor vehicles, cushions for chairs, settees, sofas and such like seating surfaces and the expression "spring interior unit" as used herein refers to all uses for which spring interior units are used in the bedding, furniture and allied industries.

It is known to provide machines which will take a coil of wire, preferably specially tempered spring wire, and drive that wire through a die so that the wire is rotated into a conventional hour-glass shape and to provide means which automatically sever the formed spring when the necessary number of convolutions have been made from the remainder of the wire and to provide means which twist the bare end of the wire over the end convolution thus locking the wire and forming a conventional hour-glass spring as is known in the upholstery trade for use in the manufacture of spring interior units.

Having thus formed the hour-glass spring, it is then the practice for an operator to take a plurality of such hour-glass springs to place them in rows, for example, two rows of springs will be placed adjacent to each other at the start of the spring interior unit and then locate them relative to a machine where a thinner length of wire is driven in a spiral manner so that the spiral winds round the end convolution of the two rows of springs at the top and bottom thus locking the end convolutions of the two rows together. Having thus joined the two rows of springs together the operator then collects another row of springs places them adjacent to one of the first rows of springs and advances the springs to the station at which the spring wire is again driven forward to lock the end convolutions of the rows together to form two rows of springs and so on until the necessary number of rows of springs have all been joined together.

It will be appreciated that this is labour intensive and time consuming operation and it is one object of the present invention to provide an improved apparatus for the automation of this process.

According to the present invention there is provided apparatus for the manufacture of spring interior units from a coil of wire which comprises at least one conventional hour-glass forming spring machine, means for feeding the springs so formed from the said spring forming machine to a conveyor having individual pocket members for locating individual hour-glass springs, means for feeding the springs in the conveyor to a station whereat a plurality of the springs maybe displaced from the conveyor simultaneously, means for so displacing the springs from the conveyor, means for positioning the plurality of springs in a row relative to another plurality of springs in a row and means for joining the end convolutions of said two rows of springs together and means for repeating the operation until a plurality of rows have been joined together at their end convolutions.

According to the present invention the apparatus consists of a conveyor which receives the hour-glass springs formed by aconventional spring manufacturing machine and preferably two such machines are adapted to feed the springs into a conveyor alternatively one from each side until a plurality of springs are located in a row and the springs in the row are then advanced to a station whereat said predetermined plurality of springs in the row may be removed from the conveyor to a position where they may be joined to a similar row of springs by substantiall conventional means.

In order that the present invention may be more readily understood reference is now made to the accompanying drawings, in which.

Figure 1:
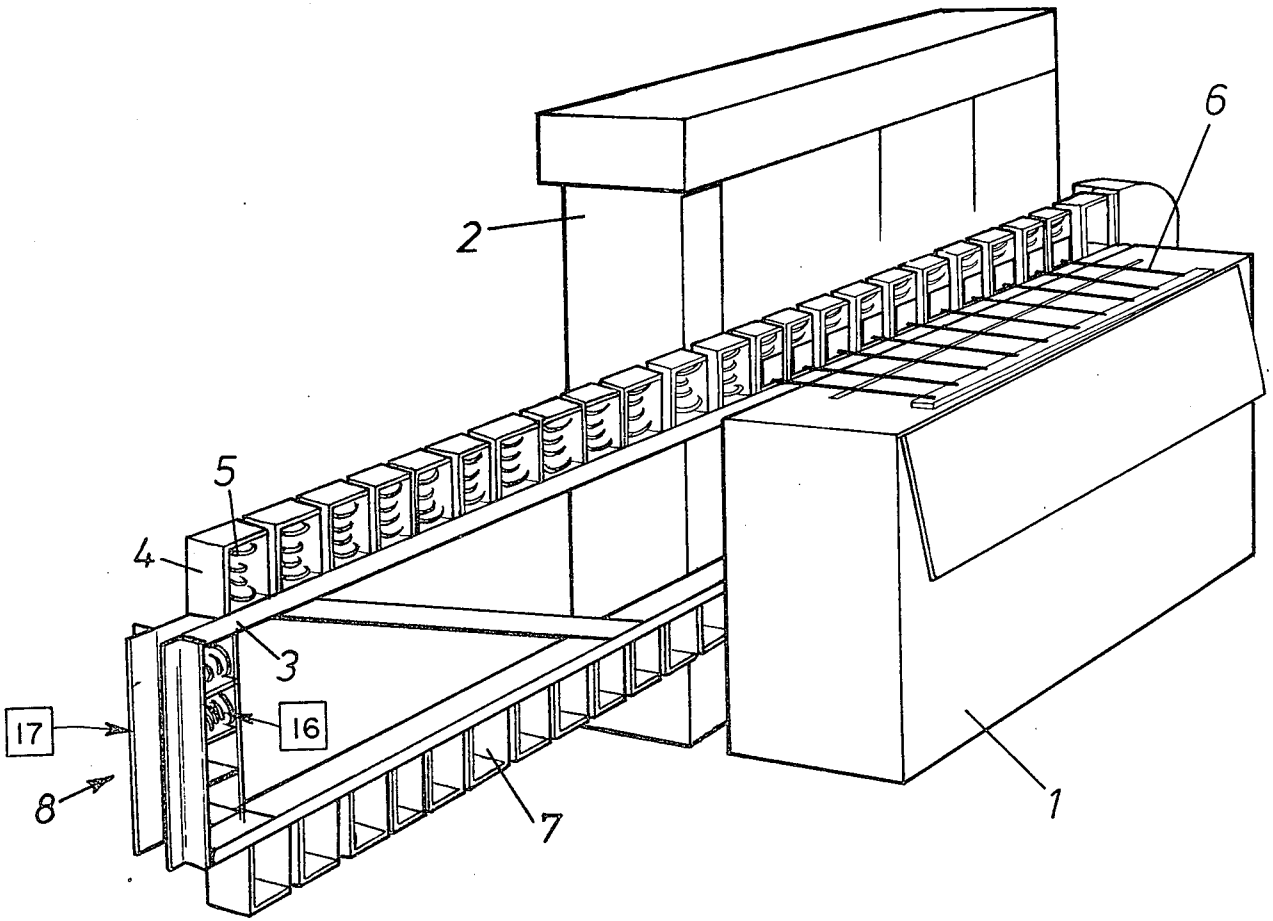
FIG. 1 is a perspective view of conveying apparatus according to the present invention.
Figure 2:
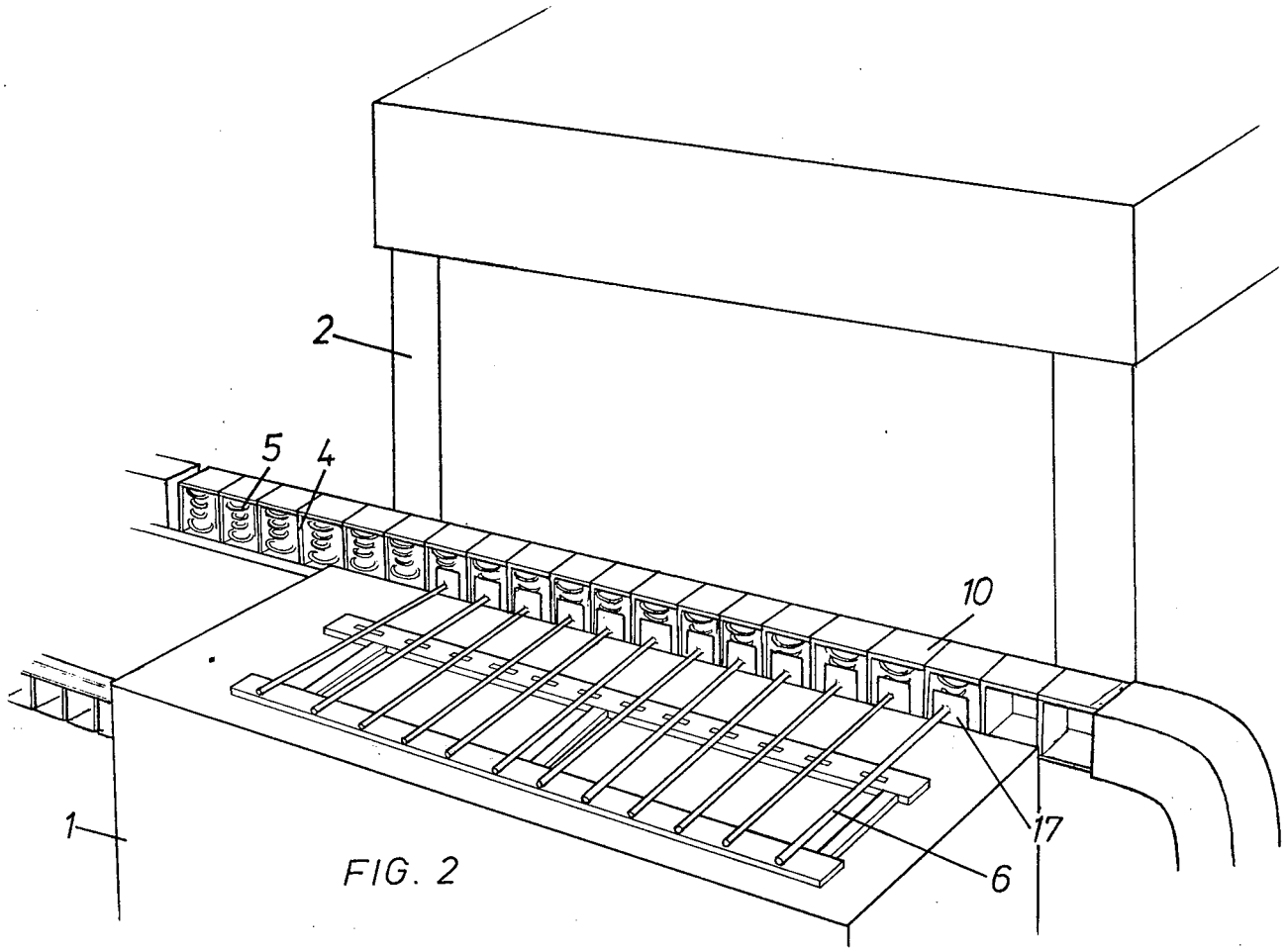
FIG. 2 is a perspctive view of apparatus showing the location on which the springs are removed from said conveyor.
Figure 3:
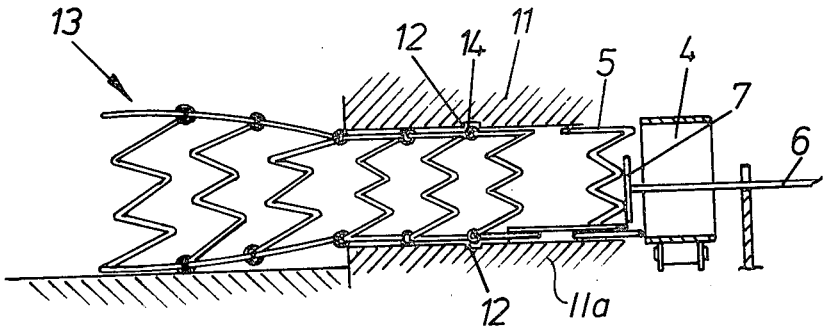
FIG. 3 is a detailed cross-sectional part of FIG. 2.
Figure 4:
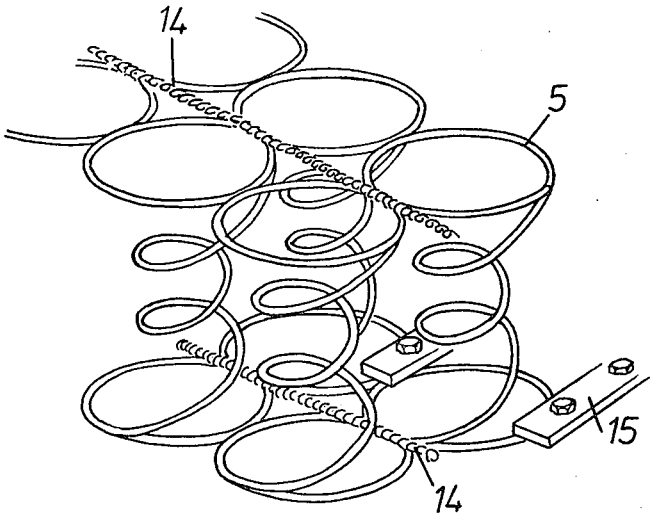
FIG. 4 is a perspective view showing a part of a spring interior mattress unit when formed according to the present invention.

In the Figures a conveyor member consists of a plurality of box-like members 4 each adapted to receive a conventional hour-glass spring 5 formed by conventional hour-glass spring making machine. In FIG. 1 two such hour-glass spring making machines shown as 16 and 17 adapted to feed springs as shown by the arrows, may be provided either side of the the small vertical rise portion indicated at 8 so that the empty containers 4 are filled by the hour-glass springs in the vicinity of the vertical portion 8 and the hour-glass springs are then advanced by the conveyor by drive means located in housing 1 to a position relative to an upper surface of the housing 1 where a plurality of rods 6 having pusher blades 17 are provided. The arrangement of the drive for the conveyor is such that when a plurality of hour-glass springs in pockets 4 are all assembled opposite a pusher blade 17 on the table 1 the conveyor 4 is stopped in its advance and the push rods 6 with the pusher blades 17 are actuated to remove a plurality of springs 5 simultaneously from the conveyor 4 thus leaving the empty pockets 7 to return to the filling station 8. The row of springs then pass beneath the canopy 2 to a position where they are compressed by a press 11 acting on a reaction member 11*a* (FIG. 3). The members 11 and 11*a* have lateral grooves 12 formed therein and in the compressed condition the end convolutions of the springs are adapted to overlap one to another. A spring member 14 is then formed from a die by forcing a length of wire through a convoluted die and in so forming it the spring member 14 winds out from the sides of the canopy 2 into the groove 12 and winds itself over the end convolutions of the springs 5 and locks them together in a manner more readily illustrated by reference to FIG. 4. It will be observed that the now formed spring interior assembly is guided by the end convolutions of the springs 5 being held in place by guide members 15, which overlie the end convolutions of the edge springs.

The synchronisation of the machine is such that the spring making machines continuously produce springs for feeding into the loading station 8 but a row of springs is then positioned relative to the table 1 when the pusher blade 17 forces a row of springs beneath the canopy 2 whence each successive row of springs are joined together by the spring wires 14 and after a predetermined number of rows of springs 5 have been joined together there is a discrete gap so that the next row of springs is not joined to the previously joined rows thus making individual spring interior units of predetermined number of rows of spring members. It will be appreciated that the present invention provides apparatus which enables a fully formed spring interior unit as hereinbefore defined to be formed as a continuous process from coils of wire used in the manufacture of conventional hour-glass spring units.

We claim:

1. Apparatus for the manufacture of spring interior units from a coil of wire which comprises in combination more than one conventional hour-glass forming spring machine, means for feeding the springs so formed from each of said spring forming machines alternatively one from each side to opposite sides of a conveyor having individual pocket members for locating individual hour-glass springs, means for feeding the springs in the conveyor to a station whereat a predetermined plurality of the springs may be displaced from the conveyor simultaneously, means for simultaneously displacing the predetermined plurality of springs from the conveyor, means for positioning the plurality of springs in a first row relative to another plurality of springs in a second row between an upper and lower press member each having a lateral groove in their opposing flat faces and means for moving one of said press members toward the other to simultaneously compress said first and second rows of hour-glass springs with the end convolutions of springs in each row adjacent said lateral grooves in position to wind a convoluted spring around the end convolution of adjacent springs as said convoluted spring is passed from a convoluted die through said lateral groove with said hour-glass springs in compressed condition and means for repeating the operation until a plurality of rows have been joined together at their end convolutions.

2. Apparatus according to claim 1 having two conventional hour-glass forming spring machines.

3. Apparatus according to claim 2 having a plurality of simultaneously acting pusher blades for displacing the hour-glass springs from their individual pockets in said conveyor.

4. Apparatus according to claim 1 having means which advance a plurality of rows of springs to form the spring interior unit as hereinbefore defined with a predetermined number of rows of springs.

5. Apparatus according to claim 2 having means which advance a plurality of rows of springs to form the spring interior unit as hereinbefore defined with a predetermined number of rows of springs.

6. Apparatus according to claim 3 having means which advance a plurality of rows of springs to form the spring interior unit as hereinbefore defined with a predetermined number of rows of springs.

* * * * *